United States Patent [19]

Meeks et al.

[11] 4,243,098

[45] Jan. 6, 1981

[54] DOWNHOLE STEAM APPARATUS

[76] Inventors: Thomas Meeks, 3656 Virginia Ave., Lynwood, Calif. 90262; Craig A. Rhoades, 9025 Wilshire Blvd. #215, Beverly Hills, Calif. 90211

[21] Appl. No.: 93,978

[22] Filed: Nov. 14, 1979

[51] Int. Cl.[3] ..... E21B 43/24

[52] U.S. Cl. ..... 166/59; 166/303

[58] Field of Search ..... 166/59, 57, 302, 303; 175/14; 126/365, 369

[56] References Cited

U.S. PATENT DOCUMENTS

| | | | |
|---|---|---|---|
| 2,584,606 | 2/1952 | Merriam et al. | 166/59 X |
| 3,093,197 | 6/1963 | Freeman, Jr. et al. | 175/14 |
| 3,116,798 | 1/1964 | Job, Jr. | 175/14 |
| 3,216,498 | 11/1965 | Palm | 166/59 X |
| 3,352,359 | 11/1967 | Sutliff et al. | 166/57 X |
| 4,050,515 | 9/1977 | Hamrick et al. | 166/59 X |
| 4,078,613 | 3/1978 | Hamrick et al. | 166/59 X |
| 4,159,743 | 7/1979 | Rose et al. | 166/59 X |

*Primary Examiner*—Stephen J. Novosad

*Attorney, Agent, or Firm*—Fulwider, Patton, Rieber, Lee & Utecht

[57] ABSTRACT

A downhole steam apparatus for location within the casing of a well borehole to facilitate oil recovery. A housing adapted to be lowered into the borehole includes a combustor for mixing and burning fuel and air, and a heat exchanger having an array of water tubes exposed to the heated gases from the combustor for converting water into steam. The steam is injected downwardly into the borehole, and the spent gases pass into the annulus between the casing and the housing. An expansible packer seals off the annulus between the steam injection area and the spent gas injection area. Compressed air for combustion is supplied at the lower spent gas pressure. Various arrangements are disclosed for the water tube array in the heat exchanger.

10 Claims, 6 Drawing Figures

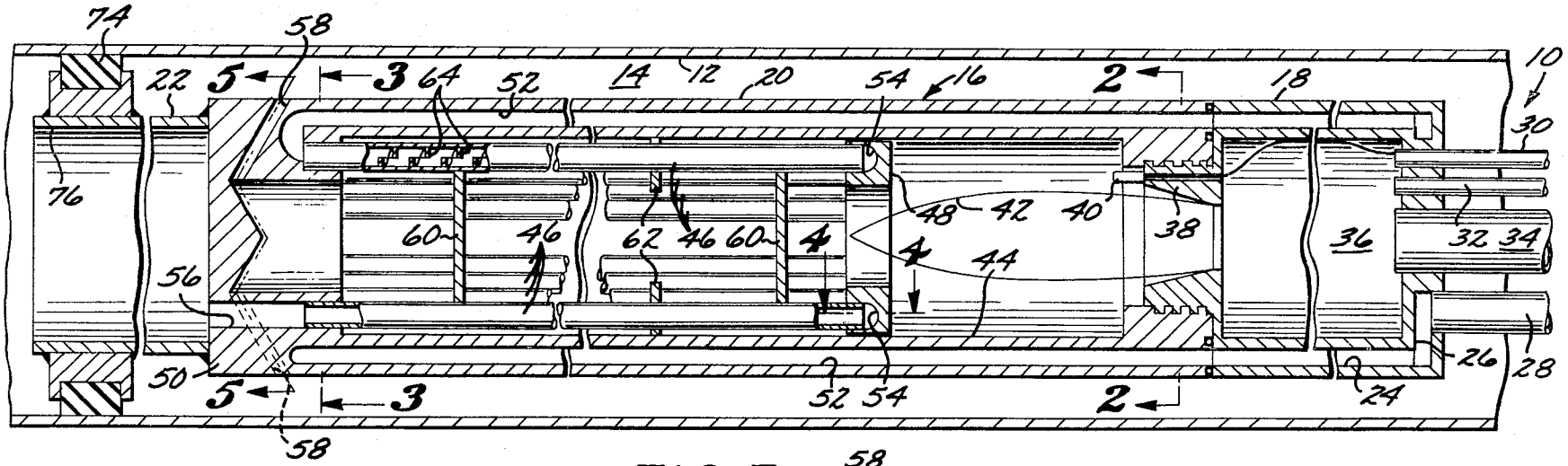
FIG. 2
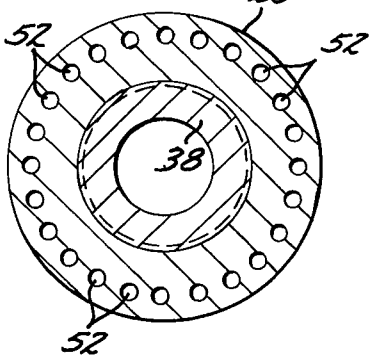
FIG. 4
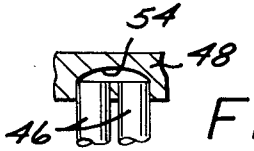
FIG. 5
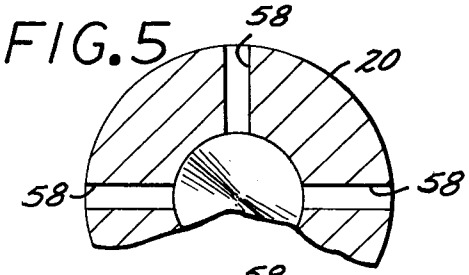
FIG. 3
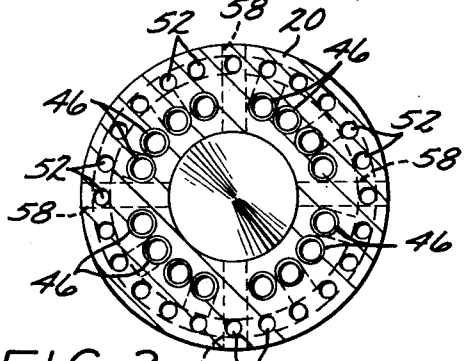
FIG. 6
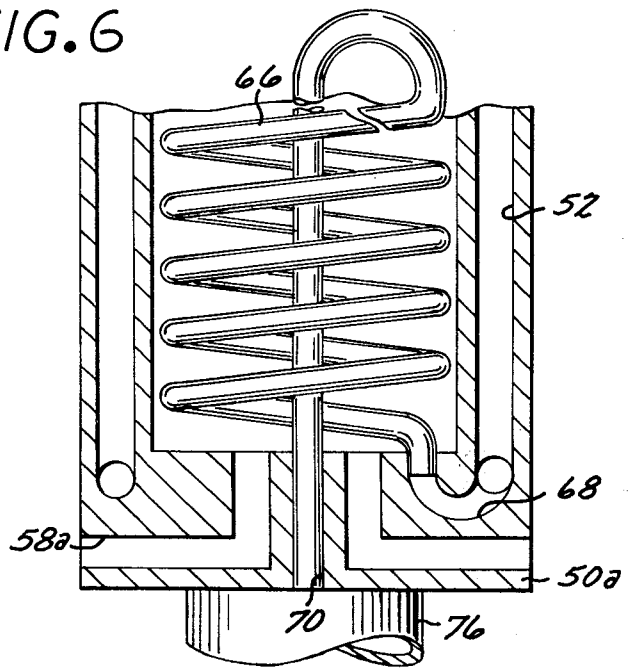

DOWNHOLE STEAM APPARATUS

BACKGROUND OF THE INVENTION

1. Field of the Invention

The present invention relates to a downhole steam apparatus for generating steam in situ to facilitate oil recovery from relatively deep wells.

2. Description of the Prior Art

Initial production from an oil well utilizes the pressure of gases in the oil formation. This is followed by pumping when the gas pressure diminishes. Eventually, even pumping is inadequate to produce acceptable quantities of oil and resort must be had to secondary recovery methods. These include thermal stimulation of the well by raising the temperature of the oil formation to lower the oil viscosity and enhance its flow.

Various types of thermal stimulation have been utilized, including electric or hot water heaters, gas burners, in-situ combustion, and hot water or steam injection. Of these, steam injection has many advantages.

Present systems for injecting steam are not effective in deep wells. In most such systems the steam is generated on the surface and piped down through the casing to the base of the borehole. In a deep well a considerable amount of heat is lost through the casing, and the temperature and quality of the steam is generally inadequate to effectively thermally stimulate formations at the base of the borehole.

Prior art attempts to generate steam in-situ or downhole have been ineffective since combustion requires that the fuel and air be provided at the pressure of the steam discharged from the combustor. The size and complexity of air compressors required to provide such high pressure become economically prohibitive.

An effective system of generating steam of high quality and temperature in-situ is desirable because flooding the formation with such steam has been found to significantly lower the flow resistance of the oil in the vicinity of the borehole, thereby enabling extraction of the displaced oil. The steam penetrates and heats the formation over a considerable distance, and consequently oil production is greatly improved in viscous oil-bearing sands from which pumping is impractical.

SUMMARY OF THE INVENTION

According to the present invention, a downhole steam apparatus is provided which includes a combustion section to which conduits are connected for providing fuel and an oxidizing fluid for mixing and burning. The apparatus includes a heat exchanger connected to the combustion section to receive the heated gases and convert water fed to a separate portion of the heat exchanger into steam.

The spent gases from the heat exchanger are discharged into the annulus between the heat exchanger and the borehole casing, and thereafter pass to the surface. The steam generated in the heat exchanger is discharged downwardly into the base of the borehole for heating the adjacent oil formation.

The apparatus includes a packer expansible against the casing to isolate the areas of steam injection and spent gases discharge so that the high pressures of the steam injection zone do not exist in the heated gas portion of the heat exchanger. Consequently, the compressed air or other oxidizing fluid can be supplied at the lower pressures existing in the combustor, rather than at the higher pressures of the injected steam.

The heat exchanger includes an array of water tubes which may be longitudinally oriented to parallel the flow of heated gases, or spirally oriented about the heated gas chamber. Suitable baffle means are preferably incorporated in the heated gas chamber of the heat exchanger and in the water tubes to induce turbulent flow and improved heat exchange.

Other objects and features of the present invention will become apparent from consideration of the following detailed description taken in connection with the accompanying drawings.

BRIEF DESCRIPTION OF THE DRAWING

FIG. 1 is a longitudinal cross-sectional view of a portion of a well bore casing, illustrating the present downhole steam apparatus in operative position;

FIG. 2 is a view taken along the line 2—2 of FIG. 1;

FIG. 3 is a view taken along the line 3—3 of FIG. 1;

FIG. 4 is a view taken along the line 4—4 of FIG. 1;

FIG. 5 is a view taken along the line 5—5 of FIG. 1; and

FIG. 6 is a partial longitudinal cross sectional view of another form of heat exchanger.

DESCRIPTION OF THE PREFERRED EMBODIMENTS

Referring now to FIGS. 1 through 5, there is illustrated a downhole steam generator or apparatus 10 adapted to be inserted within the tubular casing 12 of a well borehole. Steam is generated by combustion of fuel and an oxidizing fluid, such as diesel fuel and compressed air. Combustion takes place in a water cooled combustion chamber from which heated gases pass to a tubular heat exchanger. Water vaporization produces steam which is injected downwardly into the borehole to enhance oil recovery, as by decreasing the viscosity of oil in the borehole formation.

The inner diameter of the casing 12 is typically $6\frac{1}{2}$ inches. Accordingly, the apparatus 10 is preferably made with an outside diameter of approximately $5\frac{1}{2}$ inches to define a space or annulus 14 between the apparatus 10 and the casing 12.

The apparatus 10 comprises an assembly or housing 16 which includes a combustion section or combustor 18 and a heat exchanger section or heat exchanger 20 having a downward extension 22. The terms "upper" and "lower" refer to the orientation of the apparatus 10 in the borehole.

In one suitable embodiment the combustor 18 is approximately six feet long. It is cylindrical and includes a plurality of water passages 24 which are closed at their upper ends except for a radially inwardly directed passage 26 which connects the passages 24 to a water feed line or conduit 28 extending to surface equipment (not shown).

In addition to the water conduit 28, an oxygen conduit 30, a fuel conduit 32, and an oxidizing fluid conduit 34 are also connected to the upper end of the combustor 18, the conduits 30, 32 and 34 extending into communication with an internal chamber 36 of the combustor 18.

Diesel oil and compressed air are preferred combustion materials, but it will be apparent that other materials may be utilized if desired.

The lower end of the combustor 18 includes a threaded, reduced diameter nozzle section 38, which mounts a suitable ignitor schematically indicated at 40.

On start up of the apparatus 10, oxygen and fuel are fed into the chamber 36 and ignited by operation of the ignitor 40. The particular form of ignitor 40 is not illustrated in detail because it does not form a part of the present invention. A suitable ignitor could be a spark plug or the like actuated by an electrical charge derived from electrical leads (not shown) extending to the surface.

Once the apparatus 10 is started, oxygen flow is terminated and compressed air is fed to the system for combustion. The burning fuel and air pass through the central opening or nozzle of the section 38 and form a downwardly extending flame generally indicated at 42.

The nozzle section 38 is threaded in fluid tight relation into a complemental central opening or inlet in the heat exchanger 20. The inlet opens into an elongated internal first portion or gas chamber 44 of the heat exchanger 20. In the embodiment illustrated, the heat exchanger 20 is approximately 36 feet long and includes a plurality of parallel, longitudinal water tubes 46 extending from the bottom end to approximately four feet from the upper end. The tubes 46 are approximately 0.5 inches in outside diameter, and have a wall thickness of approximately 0.065 inches.

The upper ends of the tubes 46 are received within suitable openings in an annularly configured cylindrical header 48 which is mounted within the chamber 44. The opposite or lower ends of the tubes 46 are similarly received within a plurality of openings in a cylindrical header 50 which closes the lower end of the gas chamber 44.

As generally indicated in FIGS. 2 through 4, the heat exchanger 20 includes a plurality of parallel, circumferentially arranged and longitudinally oriented water passages 52 in communication with the water passages 24 of the combustor 18. The lower ends of the passages 52 are reversely directed to admit water to the lower ends of every other one of the heat exchanger tubes 46. The upper ends of the tubes 46 are connected by passages 54, as seen in FIG. 4, to adjacent tubes 46. Thus, the water makes an upward pass through half the tubes 46, turns in the passages 54, and makes a second, downward pass through the other half of the tubes 46, from which the water passes to a plurality of steam discharge passages 56 formed in the header 50.

The circumferential arrangement of the tubes 46 about the cylindrical chamber 44 places them in thermal exchange relation with heated gases flowing downwardly through the chamber 44. The base or lower end of the chamber 44 is made conical to direct the spent gases radially outwardly into four spent gas passages 58 which, as seen in FIG. 5, extend radially outwardly and upwardly. The spent gases are thus discharged into the annulus 14 and pass upwardly to the surface.

The heat exchanger 20 preferably includes baffles spaced along its length to cause the heated gases to follow circuitous flow paths which bring the gases into repeated, more prolonged contact with the peripheries of the tubes 46 for improved heat exchange. The baffles may include, for example, a plurality of circular plates or elements 60 having arcuate cut outs in their peripheries for welded connection to the radially inwardly oriented portions of the tubes 46. Alternating with the elements 60 are a plurality of doughnut or annularly shaped plates or elements 62 which are each characterized by a plurality of circumferential openings to receive the tubes 46, and a central opening to permit passage of the heated gases through the element 62. The elements 60 and 62 are longitudinally spaced apart along the length of the chamber 44 adjacent the tubes 46 and direct the flow of heated gases in a generally undulating, circuitous pattern.

Each of the water tubes 46 also preferably includes baffles or internal flow directors in the form of spiral directors 64 which induce a turbulent, swirling water flow for heat transfer.

FIG. 6 illustrates an alternative embodiment in which the water tube array takes the form of a helical coil 66 connected at its downstream or lower end to the water passages 52 by a circular passage 68 in a header **50*a* similar to the header 50 of the first embodiment. The opposite end of the coil 66 is reversely formed and extends downwardly through the center of the coil for connection to an opening 70 formed in the header 50*a*. The header 50*a* also includes radially outwardly directed passages 58*a* corresponding to the spent gas passages 58** of the first embodiment.

Other forms of heat exchanger will suggest themselves to those skilled in the art, although the embodiment of FIG. 1 has been found to be particularly effective.

The downwardly extending cylindrical extension 22 of the heat exchanger 20 mounts a packer diagrammatically indicated at 74. The packer 74 is carried by the apparatus 10 for sealing engagement with the casing 12. Many suitable types of packers are known to those skilled in the art which are operative to expand against the casing and provide the desired fluid tight seal. These may include a fluid expansible type requiring a connection (not shown) to a fluid source such as the fluid conduit 34; or a thermally responsive type; or a type adapted to seat by an upward pulling upon the drill string; or a type which seats upon twisting of the drill string. The latter type is that which is diagrammatically indicated.

In operation of the apparatus 10, after combustion has been initiated, as previously indicated, and the packer 74 is seated, heated gases are developed at a temperature of approximately 3200 degrees Farenheit. In passing through the four foot space between the nozzle section 38 and the header 48, the temperature drops to approximately 1650 degrees Farenheit by virtue of heat transfer, particularly by hot gas radiation, to the water passages 52 which surround the zone of the flame 42. This preheats the water before it reaches the tubes 46 and also cools the walls of the apparatus 10 to avoid undesirable overheating.

On passing through the remainder of the chamber 44, the heated gases give up further heat to the preheated water in the tubes 46. Water passing upwardly through the tubes 46 is raised in temperature by the heated gas and begins to boil at the upper ends of these tubes. As the water reverses its path and flows downwardly through the other tubes 46, it vaporizes and is discharged as steam through the passages 56 and out of the discharge outlet 76 of the extension 22. The steam in this injection zone is at a pressure of approximately 2000 lbs. per square inch absolute. It is estimated that close to 90% of the heat released in the combustion process is recovered in the steam for a steam outlet quality of approximately 70%.

The spent gases at the lower end of the heat exchanger 20 leave the passages 58 at a temperature of approximately 700 degrees Farenheit. This is low enough to avoid high temperature damage to the adjacent walls of the casing 12. Further heat transfer occurs as the spent gases pass upwardly through the annulus 14. Heat passes to the adjacent heat exchanger portions defining the water passages 52, and also then to the surrounding earth formation. The temperature of the spent gases at the upper end of the apparatus 10 is thereby reduced to approximately 432 degrees Farenheit, which is an acceptable level of temperature exposure for electrical and other connections in that area.

The relatively high pressure steam injection zone is isolated by the packer 74 from the relatively low pressure spent gases injection zone in the annulus adjacent the passages 58. Consequently, compressed air for the combustor 18 need only be supplied at a pressure sufficient to overcome the back pressure existing in the spent gases injection zone, which is approximately 250 to 300 psia. Consequently, much less elaborate and expensive air compressor equipment is needed, compared to the air compressor equipment necessary if air had to be supplied at the 2000 psia which exists in the steam pressure injection zone adjacent the discharge outlet 76.

The in-situ generation of steam by the present apparatus 10 completely eliminates the heat losses which characterize those systems utilizing surface steam generators. Moreover, the described arrangement of heated gas and water passages minimizes thermal gradients, and consequently structural stresses, which significantly prolongs service life and reduces maintenance costs.

Various modifications and changes may be made with regard to the foregoing detailed description without departing from the spirit of the invention.

We claim:

1. Downhole steam apparatus comprising:

housing means for location within the casing of a well borehole whereby said housing means defines an annulus with said casing;

a combustion section in said housing means for mixing and burning fuel and an oxidizing fluid;

a heat exchanger section in said housing means including a first portion having an inlet connected to said combustion section for receiving heated gases from said combustion section, said first portion further having an outlet for discharging spent gases into said annulus, said heat exchanger section further including a second portion having an inlet for receiving water and an outlet for discharging steam downwardly into said borehole, said second portion being located in heat exchange relation to said first portion for conversion of said water to steam by said heated gases;

conduit means connected to said combustion section and to said second portion of said heat exchanger section for supplying said fuel and oxidizing fluid, and said water, respectively; and packer means carried by said housing means for location in said annulus between said outlets of said first and second portions, said packer means being adapted for expansion into sealing engagement with said casing to isolate the casing area into which the high pressure steam is discharged from the casing area into which the relatively low pressure gases are discharged whereby said fuel and oxidizing fluid can be supplied approximately at said low pressure.

2. Downhole steam apparatus according to claim 1 wherein said outlet of said second portion of said heat exchanger section is oriented to direct said steam downwardly.

3. Downhole steam apparatus according to claim 1 wherein said outlet of said first portion of said heat exchanger section is directed outwardly and upwardly to enhance flow of said heated gases upwardly in said annulus.

4. Downhole steam apparatus according to claim 1 wherein said second portion of said heat exchanger comprises an arrangement of water tubes surrounding said first portion.

5. Downhole steam apparatus according to claim 4 wherein said first portion includes baffle means to effect changes in the direction of flow of said heated gases through said first portion to enhance heat transfer from said heated gases to the water in said second portion.

6. Downhole steam apparatus according to claim 5 wherein said water tubes include longitudinally oriented parallel runs surrounding said baffle means.

7. Downhole steam apparatus according to claim 5 wherein said water tubes include a spiral run adapted to encircle said baffle means.

8. Downhole steam apparatus according to claim 4 wherein said water tubes include internal flow directors to induce turbulent water flow through said water tubes.

9. Downhole steam apparatus for location within the casing of a well borehole, said apparatus comprising:

a combustor for mixing and burning fuel and an oxidizing fluid and thereby producing heated gases;

a heat exchanger having a downward extension and including a first portion having an inlet connected to said combustor for receiving said heated gases, said first portion further having an outlet for discharging spent gases into said casing for upward passage through said casing, said heat exchanger further including a second portion having an inlet for receiving water and an outlet for discharging steam for downward passage through said extension and into said borehole, said second portion being located in heat exchange relation to said first portion for conversion of said water to steam by said heated gases, and for conversion of said heated gases to said spent gases;

conduit means connected to said combustor and to said second portion of said heat exchanger for supplying said fuel and oxidizing fluid, and said water, respectively; and a packer carried by said downward extension between said outlets of said first and second portions of said heat exchanger and expansible against said casing to seal off the high pressure steam injection area from the lower pressure spent gas injection area whereby said oxidizing fluid can be supplied at a pressure approximating said lower pressure.

10. Downhole steam apparatus according to claim 9 wherein said first portion is arranged such that said heated gases flow in a downward direction through said first portion as said heated gases travel from said inlet toward said outlet of said first portion.

* * * * *